United States Patent [19]

Friton

[11] Patent Number: 4,486,965

[45] Date of Patent: Dec. 11, 1984

[54] FOOTWEAR WITH OVERLAPPING CLOSURE STRAP MEANS

[75] Inventor: Michael R. Friton, Eugene, Oreg.

[73] Assignee: Nike, Inc., Beaverton, Oreg.

[21] Appl. No.: 564,689

[22] Filed: Dec. 23, 1983

Related U.S. Application Data

[63] Continuation-in-part of Ser. No. 378,381, May 14, 1982, abandoned.

[51] Int. Cl.[3] ..... A43B 11/00

[52] U.S. Cl. ..... 36/50; 2/DIG. 6; D2/309

[58] Field of Search ..... 36/50, 51, 114, 129, 36/11.5; 2/DIG. 6; D2/309, 310

[56] References Cited

U.S. PATENT DOCUMENTS

| | | | |
|---|---|---|---|
| 201,451 | 3/1878 | Sanford . | |
| 770,535 | 9/1904 | Phillips . | |
| 1,497,568 | 6/1924 | Kelley . | |
| 1,643,108 | 9/1927 | Bendelari . | |
| 2,534,975 | 12/1950 | Johnson | 36/11.5 |
| 3,566,486 | 3/1971 | Conway . | |
| 3,626,610 | 12/1971 | Dassler . | |
| 3,845,769 | 11/1974 | Shaw . | |
| 4,079,527 | 3/1978 | Antonious . | |
| 4,114,297 | 9/1978 | Famolare . | |
| 4,215,493 | 8/1980 | Antonious . | |
| 4,270,285 | 6/1981 | Antonious . | |
| 4,275,513 | 6/1981 | Antonious . | |
| 4,282,657 | 8/1981 | Antonious . | |
| 4,308,672 | 1/1982 | Antonious | 36/50 |

FOREIGN PATENT DOCUMENTS

| | | | |
|---|---|---|---|
| 935640 | 10/1973 | Canada . | |
| 361196 | 3/1906 | France . | |
| 2375841 | 7/1978 | France | 36/50 |
| 634207 | 1/1983 | Switzerland | 36/50 |
| 7916 | of 1904 | United Kingdom | 36/50 |

OTHER PUBLICATIONS

*Velcro Product News,* May 1978, Pn No. 5, Velcro U.S.A. Inc., 681 Fifth Avenue, New York, NY 10022.

*Primary Examiner*—James Kee Chi

*Attorney, Agent, or Firm*—Banner, Birch, McKie & Beckett

[57] ABSTRACT

A closure for footwear comprising overlapping straps with strap receiving openings to permit the overlapping. The straps have pile or hook material to releasably engage cooperating pile or hook material on the upper. The closure provides ease and flexibility for engagement on the footwear.

18 Claims, 9 Drawing Figures

FOOTWEAR WITH OVERLAPPING CLOSURE STRAP MEANS

This application is a continuation-in-part of application Ser. No. 378,381 filed May 14, 1982, now abandoned.

TECHNICAL FIELD

The present invention relates broadly to footwear. More particularly, the invention relates to footwear having overlapping closure straps which use pile and hook fasteners.

BACKGROUND OF THE INVENTION

A common problem that arises when securing the upper of a shoe to a foot is achieving and maintaining a proper, yet comfortable tension of the closure means. In the past, conventional lace systems, which require an upper to be drawn together at each eyelet by a shoelace and secured by a knot, presented several problems. First, the use of shoelaces causes the pressure of the closure to be concentrated at the relatively small areas of the laces. This creates high pressure at the lace locations, causing significant discomfort to the wearer. As a consequence, shoe tongues are commonly employed to protect the foot against such pressure.

Second, persons with physical disabilities or impairments, such as arthritis, and little children find it difficult to grasp the thin laces, pull the laces to a proper tension, and secure the lace tension with a knot. Thus, physically disabled persons often are forced to wear shoes that merely slip onto their feet and do not properly support them as would a shoe snugly secured. Small children, because they have difficulty tying the laces, often go about with loose, untied laces, risking tripping over the laces and the resulting injuries.

Third, athletes commonly have problems related to standard shoe lace systems. Frequently, laces cut off circulation in an athlete's foot and irritate the top of the foot. This irritation causes swelling and tendon problems. In addition, some athletes, such as long jumpers, must frequently remove their shoes to remove debris from the shoe. Shoes with standard laces require great amounts of time to readjust properly the tension. This problem is compounded if the laces are wet.

Fourth, footwear with high tops, such as basketball shoes or hiking boots, contain many laces, requiring large amounts of time to be spent putting the shoe on and properly adjusting the lace tension. Again, laces that are wet further add to the time required.

An attempt to solve some of these problems in a sport shoe made by Dassler in U.S. Pat. No. 3,626,610 met with only partial success. In Dassler, an athletic shoe has straps with hook material secured to one side of a slot in the upper that extend over the slot to releasably engage cooperating pile material on the opposite edge. The closure straps, however, cause unequal pressure on the foot when fastened. The straps are all pulled to a closed position from the same side. As a result, the side opposite the straps remains relaxed until the straps are fastened, resulting in insufficient or unequal tension in the several straps. Such loose or uneven pressure causes discomfort to the foot and may detract from an athlete's performance.

Other attempts at remedying shoe lace problems such as U.S. Pat. Nos. 201,451 to Sanford and 1,643,106 to Bendelari employed overlapping closure straps for shoes. These shoe fastenings, however, use buttons or buckles and did not allow the ease of tension adjustment flexibility needed or required by many shoe wearers. In addition, these shoe closure systems do not involve a plurality of strap pairs, further limiting their flexibility of tension adjustment.

Another type of closure is shown in Shaw U.S. Pat. No. 3,845,769, which uses bands to tighten unyielding, limb-encircling devices for therapeutic purposes. Each band closure comprises a slot on one end of the band and a tab on the other end that fits through the slot when fastened. Cooperating hook and pile fastening material is located on both the tab and the band adjacent to the slot. The band closure would be ineffective when used on shoes, however, because the closure requires large areas of space to operate properly. The relatively small area available for shoe closure requires that a more compact and efficient closure means be used.

SUMMARY OF THE INVENTION

The present invention is directed to an upper closure means for footwear. The closure means is comprised of one or more pairs of oppositely facing closure straps. The closure straps are attached to the edges of a longitudinal slot in the upper of a shoe. The straps extend across the slot when releasably engaged and mutually overlap.

In one preferred embodiment, the upper has attached to it a plurality of closure strap pairs. Each strap has a pair of parallel, spaced legs connected to an attaching tab. The straps are disaligned on the edges of the longitudinal slot, and permanently interlocked to prevent total strap disengagement.

In another embodiment, the upper again has attached to it a plurality of closure strap pairs. Each strap has a pair of angled, spaced legs connected to an attaching tab. The straps are aligned on the edges of the longitudinal slot. When fastened, the attaching tab of either strap of the strap pair may be selectively and entirely extended through the triangular opening between the angled, spaced legs of the opposite strap.

In still another embodiment, one pair of straps with spaced, angled legs is attached to the upper portion of the longitudinal slot, and one or more pairs of straps with spaced, parallel legs are attached to the shoe upper at the lower end of the longitudinal slot.

In yet another embodiment, the straps in each pair of straps are mutually aligned across the edges of the longitudinal slot with one strap attached to one edge underlying the other strap across the slot but having an attaching tab extending outwardly through an opening in the other strap or in the upper adjacent the opposite slot edge.

The closure system of the present invention allows a shoe to be opened and closed quickly and effortlessly. The invention also allows ease of achieving proper, even tension and comfort of a shoe closure on a foot. The closure means fits all footwear and can be used advantageously by anyone.

Various advantages and features of novelty that characterize the invention are pointed out with particularity in the claims annexed hereto and forming a part hereof. However, for a better understanding of the invention, its advantages and objects obtained by its use, references should be had to the drawings which form a further part hereof, and to the accompanying descriptive matter in which there is illustrated and described embodiments of the invention.

DETAILED DESCRIPTION OF THE INVENTION

Figure 1:
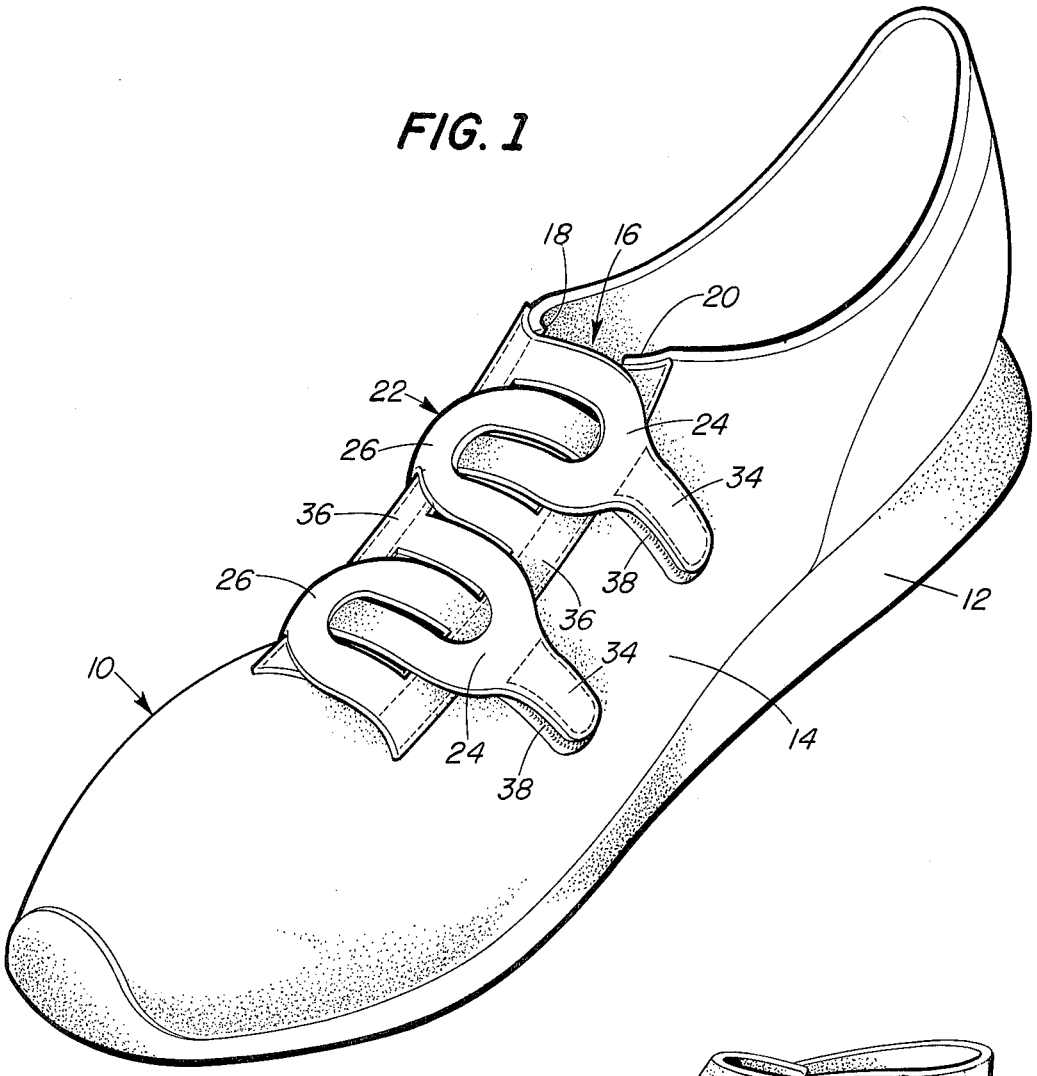
FIG. 1 is a front perspective view illustrating the present invention in use.

Referring to the drawings in detail wherein like numerals indicate like elements, there is shown in FIG. 1 an article of footwear 10. The article of footwear 10 comprises a sole 12 and an upper 14 attached to the sole 12. The upper 14 contains a longitudinal slot 16 for facilitating the entry and removal of a foot. The slot 16 has a medial edge 18 and a lateral edge 20. On the upper 14 is located an overlapping shoe closure means 22 for closing and securing slot 16. The closure means 22 comprises a plurality of oppositely attached and overlapping pairs of straps. One set of straps 24 is anchored on the medial edge 18 of slot 16 and the other set of straps 26 is anchored on the lateral edge 20 of slot 16. The straps can be made of any suitable material, such as leather. Straps 24 and 26 are detachably engaged to the upper 14 by the cooperating engagement of hook and pile fastening materials. As used herein, hook and pile fastening materials mean two cooperative material components, one of which comprises hooks and the other of which comprises pile. An example of such material is Velcro. The hooks and piles are distributed across a substantial area of the respective component materials which are engaged by pressing one component down on the other and released by pulling them apart. The terms hooks and piles are intended to include equivalent cooperative elements that function in the manner described. Pile component strips 25 are attached to straps 24 and 26 and hook component strips 38 are located on upper 14. The overlapping shoe closure straps 24, 26 draw together the medial and lateral edges 18, 20 of the longitudinal slot 16 and releasably engage upper 14 to secure the article of footwear 10 upon the foot of a user.

Figure 2:
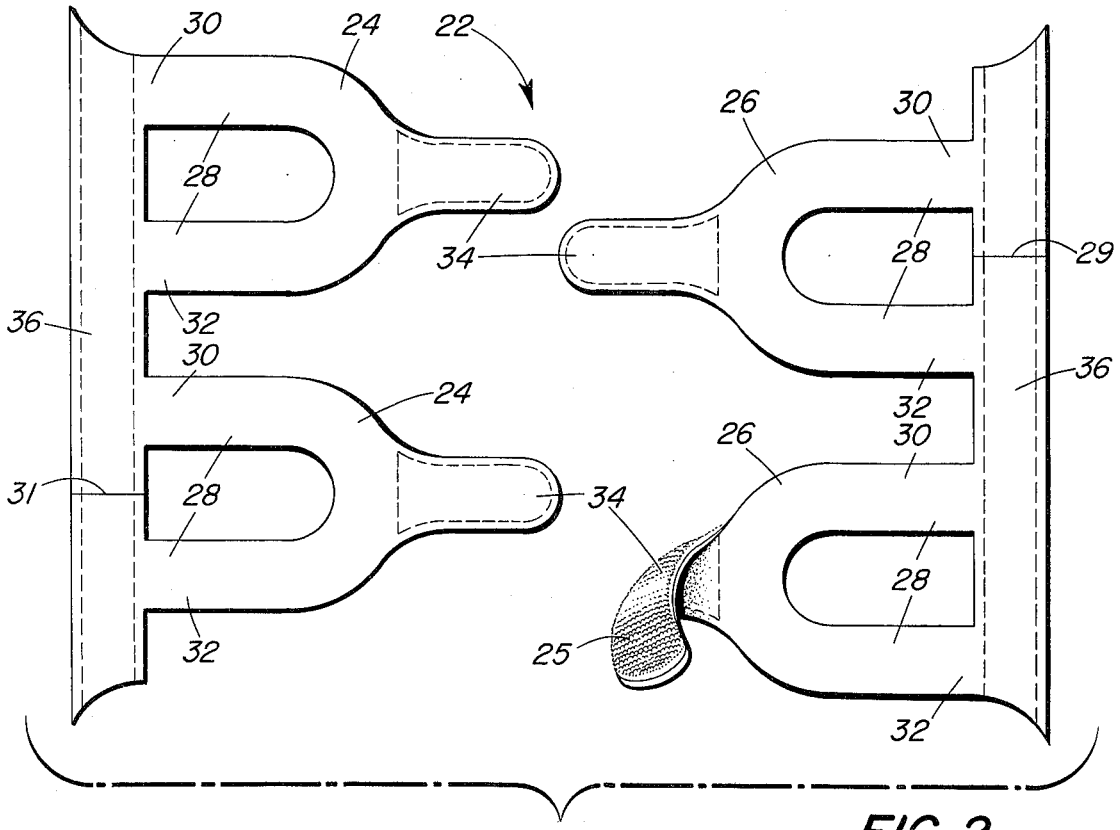
FIG. 2 is a top view of the straps of the present invention with the opposing pairs of parallel leg straps separated.
Figure 3:
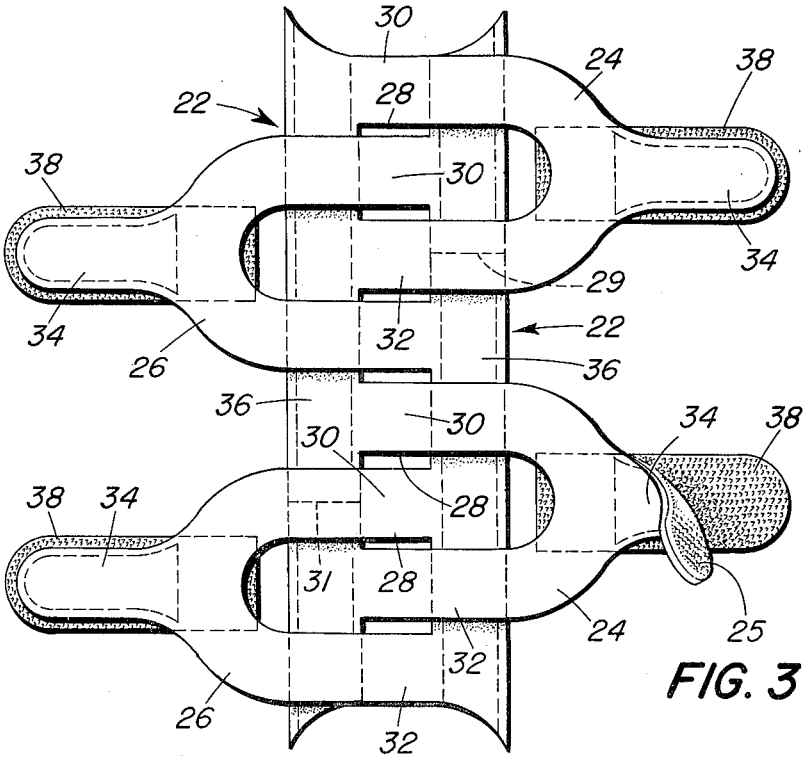
FIG. 3 is a top view of the parallel leg straps in the engaged position with one strap partially disengaged to show the engagement structure.

Referring to FIGS. 1–3, one embodiment of the overlapping shoe closure system 22 is illustrated in detail. The shoe closure means 22 comprises two pairs of closure straps. Each closure strap 24, 26 has a base portion with a bifurcated end 28 forming two spaced, parallel legs 30 and 32. At the distal end of closure straps 24 and 26 and extending from the joined legs 30 and 32 is an attaching tab 34. The medial closure strap 24 is fixedly attached to the upper 19 at medial edge 18, and the lateral closure strap 26 likewise is fixedly attached to the upper 14 at lateral edge 20. Preferably, the closure straps 24 and 26 are fixedly attached to or integrally formed with a reinforcing strip 36, which is attached adjacent to the edges 18 and 20 by sewing or other known means. The reinforcing strip 36 can be made out of any suitable material, again such as leather.

Each of the securing tabs 34 has a strip of pile material 25 sewn to the side facing the upper 14. Secured to the upper 14 is a corresponding strip of hook material 38. The hook material strip 38 is located adjacent to the reinforcing strip 36 and extends along the upper 14 perpendicular to slots 16 and 18 as shown in FIGS. 1 and 3. The hook strip 38 can also be located at least partially on the reinforcing strip 36 if desired.

As seen in FIG. 3, each pair of medial and lateral straps 24 and 26 are attached to upper 14 offset from one another in partially disaligned, overlapping relationship on the reinforcing strip 36. The lower leg 32 of each medial strap 24 fits into the space between legs 30 and 32 of lateral strap 26. Conversely, the upper leg 30 of lateral strap 26 fits in the space between legs 30 and 32 of medial strap 24. This configuration serves to interlock straps 24 and 26 so that even when the pile strips 25 are not releasably engaged to the hook strip 38, the two straps 24, 26 can still only partially disengage. This restriction to partial disengagement saves the wearer time putting on the shoe, because the wearer need not interlace the straps 24, 26, but only tighten and fasten them to the barbed strips 38 on the upper 14.

To assemble and mount closure means 22 having straps 24, 26 on upper 14, it is necessary to slit and thereby create a discontinuity in reinforcing strips 36 between legs 30, 32 of at least one strap of each strap pair. As seen in FIG. 2, lateral discontinuity 29 allows lower leg 32 of the upper medial strap 24 to fit into the space between legs 30 and 32 of upper lateral strap 26. Similarly, medial discontinuity 3 allows upper leg 30 of the lower lateral strap 26 to fit into the space between legs 30 and 32 of lower medial strap 24. After the two pairs of straps 24, 26 have been interlocked, reinforcing strips 36 are sewn or otherwise attached to upper 14 as was discussed previously. The straps are fastened down across discontinuities 29 and 31 to keep straps 24 and 26 interlocked.

Figure 4:
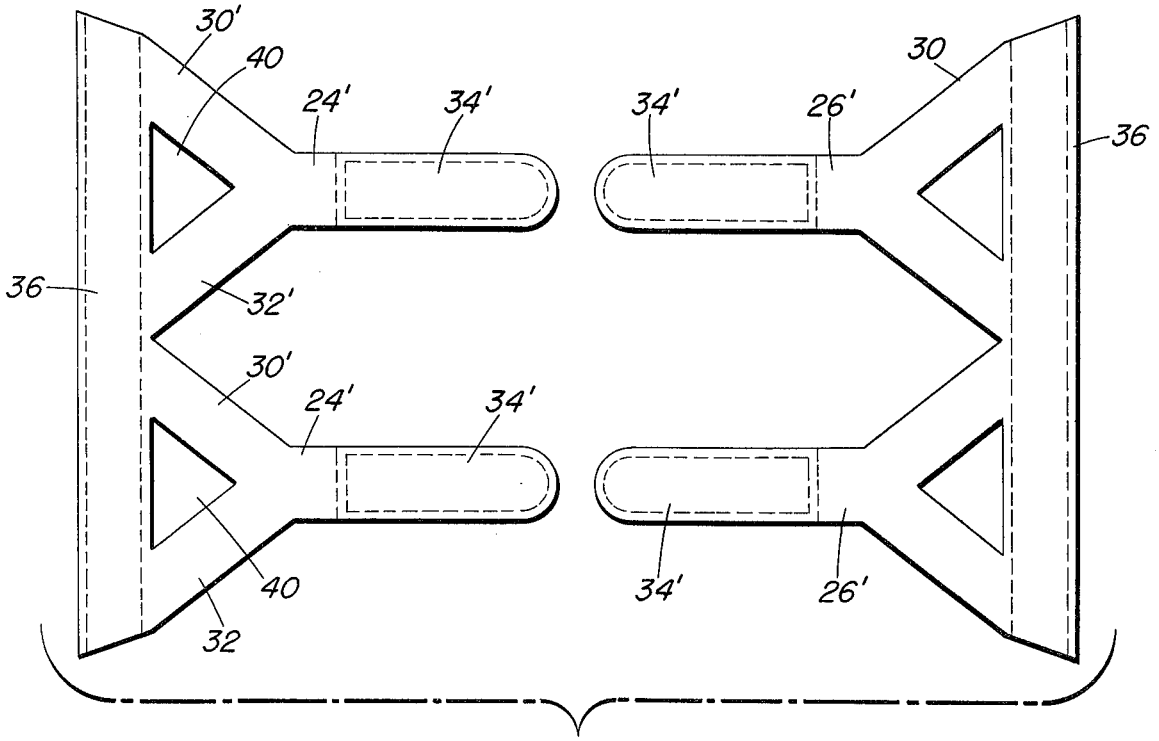
FIG. 4 is a top view of the angular leg straps with the opposing pairs of straps separated.
Figure 5:
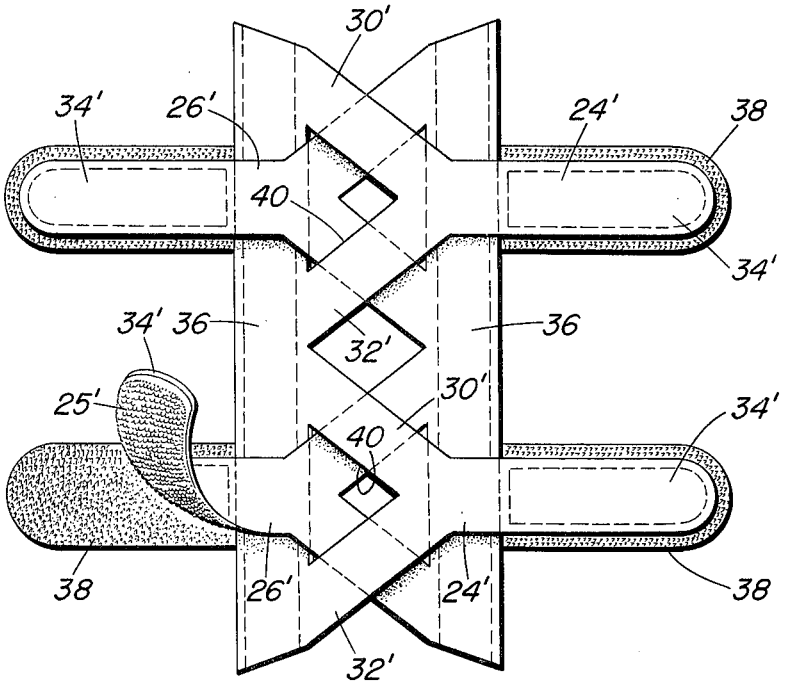
FIG. 5 is a top view of the angular leg straps system in the engaged position with one strap partially disengaged to show the engagement structure.

In another embodiment illustrated in FIGS. 4 and 5, a plurality of another type of bifurcated strap pairs is illustrated. Again, each pair is comprised of a medial strap 24′ and a lateral strap 26′. Each of the straps has a base portion with spaced, angled legs 30′ and 32′. A triangular open space 40 is located between legs 30′ and 32′ and a securing tab 34′ is located at the junction of legs 24′, 26′. It would again be preferable to integrally form the straps 24′, 26′, with or fixedly attach them to reinforcing strips 36 and then attach the reinforcing strips 36 to the upper 14. Each of the securing tabs 34′ has a strip of pile material 25′ attached to it.

As seen in FIG. 5, the angular leg closure straps are attached to the shoe upper 14 along medial and lateral edges 18 and 20. Each strap is positioned directly across from and in alignment with its cooperating pair member. When the straps 24′, 26′ are detachably engaged to the upper 14, either one of the angular leg straps, in the illustrated embodiment lateral strap 26′, fits through the triangular opening 40 in the opposite medial closure strap 24′ and then releasably engages the strip of hook material 38 located on the upper 14. Medial strap 24' thus overlaps lateral strap 26' and attaches to the opposite strip of hook material 38 on the upper 14. In this manner, each of the pairs of straps 24', 26' can be totally disengaged to allow the two edges 18, 20 of the slot 16 to e separated adequately for entry of the wearer's foot into the shoe 10.

Figure 7:
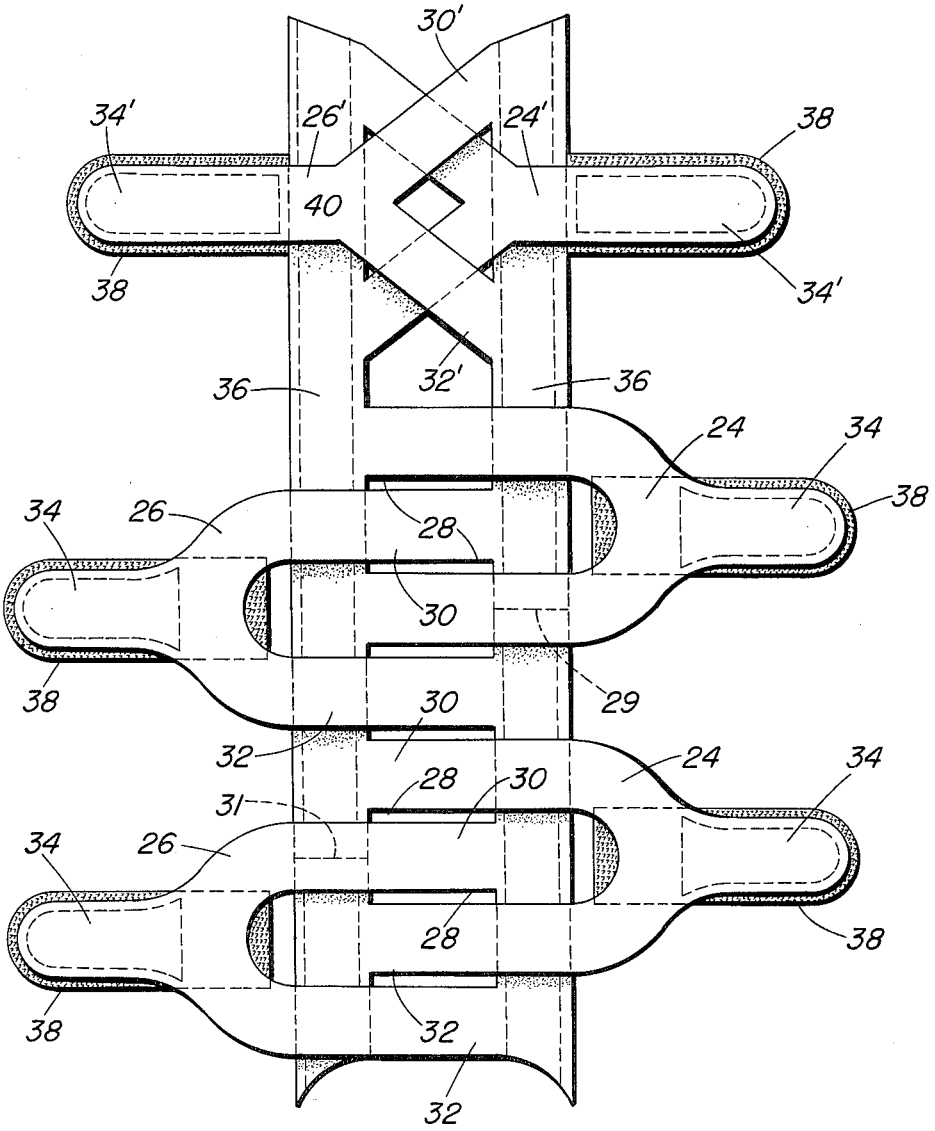
FIG. 7 is a top view of the combination of parallel leg and angular leg strap closure system in the engaged position.

FIG. 7 shows another preferred embodiment utilizing a combination of parallel leg straps 24, 26 and angular leg straps 24', 26'. In the embodiment, two pairs of parallel leg straps 24, 26 are oppositely and fixedly attached to the lower portion of slot 16 while one pair of angular leg straps 24', 26' is fixedly attached to the top of slot 16. It is again preferred to use reinforcing strips 36. In addition, as was described earlier, slits must be made in reinforcing strips 36 to form discontinuities 31 between the spaced legs 30, 32 of at least one strap of each strap pair 24, 26. The discontinuity will allow straps 24, 26 to become interlocked before mounting to upper 14 and to remaining interlocked after the discontinuities are sealed as a result of attachment to upper 14.

Figure 6:
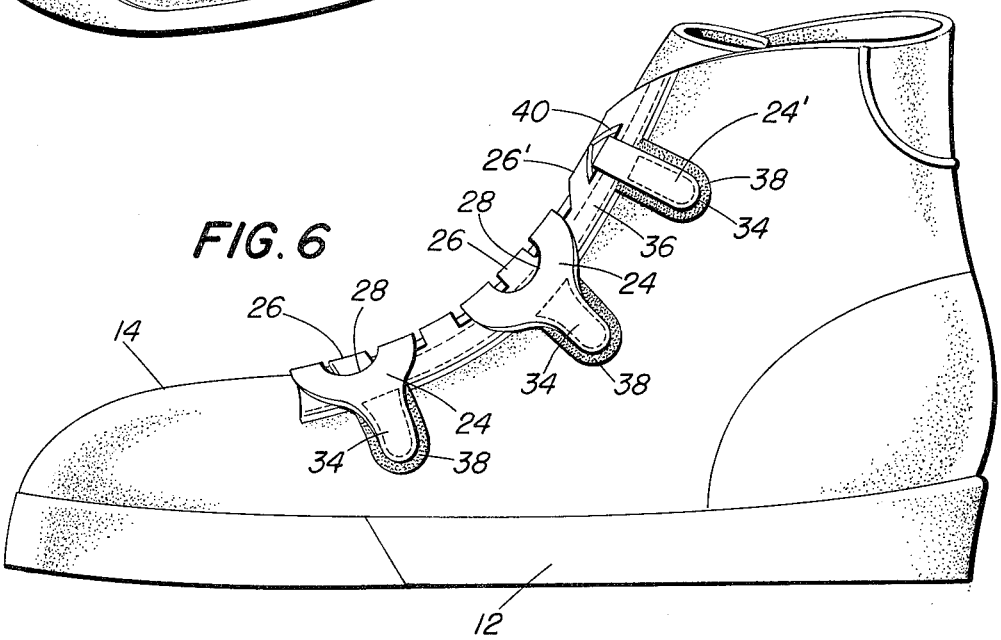
FIG. 6 is a right elevational view of the combination parallel leg and angular leg strap closure system showing the invention in use.

The combined configuration is best seen by reference to FIG. 6, which slows a hiking boot using the combination of parallel leg and angular leg straps. The embodiment has the advantage of only partially disengaging at the lower two strap pair of the closure means 24, 26, thereby limiting the need to constantly relace a shoe to the upper strap pair 24', 26'. In addition, the angular leg straps 24', 26', which totally disengage, allow the two slot edges 18 and 20 to be separated adequately for the easy entry of a foot. Thus, the advantages of both types of straps are best put to use.

Of course, other combinations of the strap types can be made to serve the user's need. In addition, as shown in FIG. 5, the straps may have stitching at various intervals along securing tab 34 or 34'. The multiple stitching would allow a user to cut the tab 34 and 34' to the appropriate size, thus eliminating overly long, useless tab material that may flap about annoyingly when the user is in motion. Also, because of the absence of thin laces, no tongue is needed in the upper to protect the user's foot against lace pressure. Tongues may be desired on some shoes, for example hiking boots, to guard a user's foot from injuring elements of the ambient.

Figure 8:
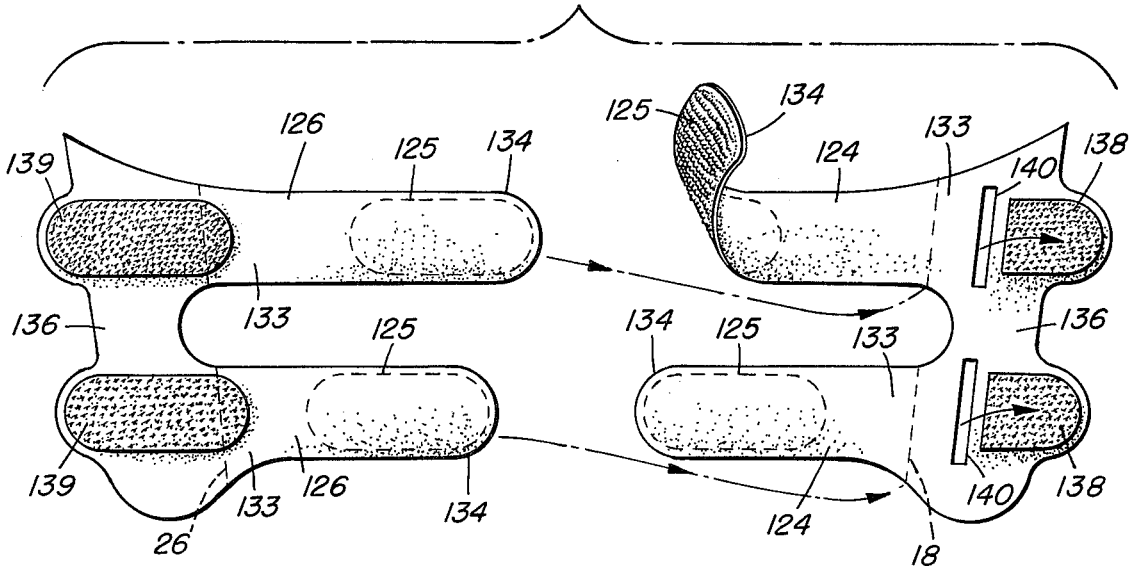
FIG. 8 is a top view of another modified form of straps of the present invention with the opposing pairs of straps separated.
Figure 9:
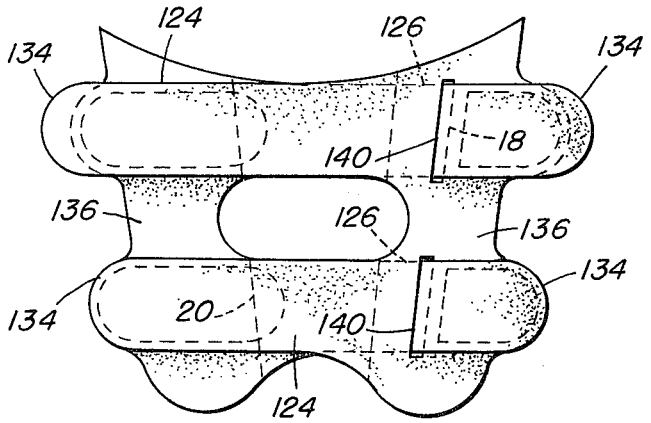
FIG. 9 is a top view of the straps of FIG. 8 in the engaged position.

In still another embodiment illustrated in FIGS. 8 and 9, a plurality of a further type of strap pairs is illustrated. Again each pair is comprised of a medial strap 124 and a lateral strap 126. Each of the straps has a base portion 133 and an attaching tab 134. Although the straps 124 and 126 may be attached directly to the shoe upper, they are preferably affixedly attached to reinforcing strips 136. It is especially preferred that the straps 124 and 126 be integral with the reinforcing strips 136. The reinforcing strips 136 are attached by stitching or otherwise to the upper. The edges 18 and 20 of the upper define the longitudinal slot 16 therebetween. Each of the attaching tube 134 has affixed thereto on the side facing the shoe upper one of the fastening components of hook or pile fastening materials. In this instance the fastening components 125 on the attaching tabs of the straps 124 and 126 embody the hook fastening materials. The corresponding pile component strips 138 and 139 are attached to the reinforcing strips 136 in positions to be engaged by the corresponding hook component strips as shown in FIGS. 8 and 9. Alternatively the pile fastening components 138 and 139 may be attached in whole or in part to the shoe upper adjacent to the reinforcing strips 136. The securing system includes openings 140 which extend through the shoe upper 14 and coaxially through the medial reinforcing strips 136 between the medial pile components 138 and the medial edge 18 of the longitudinal slot 18.

As seen in FIG. 9, the closure straps 124 and 126 are attached to the shoe upper 14 along medial and lateral edges 18 and 20. Each strap 124 is located directly across from and in alignment with its cooperating strap 126. To engage the straps 124 and 126 across the slot 16, the straps are extended across the slot with the strap 126 underlying the strap 124. The attaching tab 134 of strap 126 is threaded through the opening 140 in the upper and the medial reinforcing strip 136. Thus the attaching tab 134 of the strap 126 extends outwardly through the opening 140 to an exterior position where its hook component 125 may be engaged with the medial pile component 138. Prior to engaging the hook and pile components, the respective straps 124 and 126 may be pulled apart in opposite directions across the slot with the strap 126 extending first under the strap 124 and then outwardly through the opening 140. The straps can then be fastened to the upper by engaging hook components 125 on both sides of the slot with the pile components 138 and 139. Desirably the lower pair of straps 124 and 126 can first be pulled taut and fastened to the upper as described and then the upper straps 124 and 126 can in sequence be pulled taut and releasably fastened to the upper by the hook and pile fastening materials.

It can be seen that like the straps 24' and 26' shown in FIGS. 4 and 5, the straps 124 and 126 shown in FIGS. 8 and 9 can be totally disengaged to allow the two edges 18 and 20 of the slot to be separated adequately for entry of the wearer's foot into the shoe 10. With reference to FIGS. 4 and 5, it can be also seen that the triangular opening 40 may be eliminated on one of each of the strap pairs 24' and 26'. For example, the opening 40 can be eliminated on the straps 26' and retained on the straps 24'. Thus the straps 24' and 26' can still be engaged as shown in FIG. 5, but the engagement cannot be reversed because the strap 24' cannot then extend through strap 26'. If desired, the straps 124 and 126 may be substituted for the straps 24' and 26' in the combination closure shown in FIG. 7.

Numerous characteristics and advantages of the invention have been set forth in the foregoing description together with details of the structure and function of the invention, and the novel features thereof are pointed out in the appended claims. The disclosure, however, is illustrative only, and changes may be made in details, especially in matters of shape, size, and arrangement of parts, within the principle of the invention, to the full extent indicated by the broad general meaning of the terms in which the appended claims are expressed.

I claim:

1. Footwear comprising:

a sole;

and an upper attached to said sole;

said upper containing a longitudinal slot and securing means for securing said footwear upon a foot;

said slot having a first edge and a second edge opposite thereto;

said securing means comprising a plurality of closure strap pairs, each strap of said strap pairs comprising two spaced legs joined together at one end and an attaching tab extending from said joined edge, and hook and pile fastening materials having a hook fastening component and a pile fastening component;

a first strap of said strap pairs being fixedly attached at the end opposite the attaching tab to said first edge, and a second strap of said strap pairs being fixedly attached at the end opposite the attaching tab to said opposite second edge, said first and second straps extending in opposite directions across said slot and overlapping each other longitudinally of said slot, each of said straps having one of said fastening components attached to the attaching tab thereof on a side thereof facing said upper, with the other of said fastening components attached adjacent to the longitudinal slot edge opposite to the edge to which the strap is attached, whereby said first and second straps can be pulled taut in opposite directions in mutually overlapping relationships and releasably fastened to said upper by said hook and pile fastening material, with at least a portion of one of said straps extending through the opening between the spaced legs of said other strap when said straps are releasably fastened to said upper.

2. Footwear according to claim 1 wherein said first and second straps are aligned across said slot, and said attaching tab of either of said straps may be selectively and entirely extended through the opening between the spaced legs of said opposite strap.

3. Footwear according to claim 1 wherein said first and second straps are partially disaligned across said slot and each of said straps has a first portion extending through the opening between the spaced legs in the other strap and a second portion extending laterally outside of said other strap, said strap pair thus being permanently interlocked to prevent total disengagment of said straps.

4. Footwear comprising;

a sole;

and an upper attached to said sole;

said upper containing a longitudinal slot and securing means for securing said footwear upon a foot;

said slot having a first edge and a second edge opposite thereto;

said securing means comprising a plurality of closure strap pairs, each strap of said strap pairs comprising two spaced legs joined together at one end and an attaching tab extending from said joined edge, and hook and pile fastening materials having a hook fastening component and a pile fastening component;

a first strap of said strap pairs being fixedly attached at the end opposite the attaching tab to said first edge, and a second strap of said strap pairs being fixedly attached at the end opposite the attaching tab to said opposite second edge, said first and second straps extending in opposite directions across said slot and overlapping each other longitudinally of said slot, each of said straps having one of said fastening components attached to the attaching tab thereof on a side thereof facing said upper, with the other of said fastening components attached adjacent to the longitudinal slot edge opposite to the edge to which the strap is attached, whereby said first and second straps can be pulled taut in opposite directions in mutually overlapping relationships and relesably fastened to said upper by said hook and pile fastening material;

a first strap pair being located near the upper edge of said longitudinal slot, said first and second straps of said first strap pair being aligned across said slot, and the attaching tab of either of said straps capable of being selectively and entirely extended through the opening between the spaced legs of the opposite strap, and at least a second strap pair being located below said first strap pair on said longitudinal slot, said first and second straps of said second strap pair being partially disaligned across said slot and each of said straps having a first portion extending through the opening between the spaced legs in the other strap and a second portion extending laterally outside of said other strap, said first strap pair thus being capable of total disengagement to allow the upper portion of said slot to open fully, and said second strap pair being permanently interlocked to prevent total disengagement of said second strap pair.

5. Footwear in accordance with claims 1, 2, 3, or 4 wherein a reinforcing strip is attached adjacent to each of said first and second slot edges, said first and second straps of each strap pair being fixedly attached to said reinforcing strips.

6. Footwear in accordance with claims 3 or 4 wherein a reinforcing strap is attached adjacent to each of said first and second slot edges, said first and second straps of each strap pair being integral with said reinforcing strips, and said reinforcing strips having a discontinuity between the spaced legs of at least one strap of each of said partially disaligned strap pairs to permit said interlocking.

7. Footwear comprising:

a sole;

and an upper attached to said sole;

said upper containing a longitudinal slot and securing means for securing said footwear upon a foot;

said slot having a first edge and a second edge opposite thereto;

said securing means comprising a pair of closure straps, each strap of said strap pair comprising two spaced legs joined together at one end and an attaching tab extending from said joined edge, and hook and pile fastening materials having a hook fastening component and a pile fastening component;

a first strap of said strap pair being fixedly attached at the end opposite the attaching tab to said first edge, and a second strap of said strap pair being fixedly attached at the end opposite the attaching tab to said opposite second edge, said first and second straps extending in opposite directions across said slot and overlapping each other longitudinally of said slot, each of said straps having one of said fastening components attached to the attaching tab thereof on a side thereof facing said upper, with the other of said fastening components attached adjacent to the longitudinal slot edge opposite to the edge to which the strap is attached, whereby said first and second straps can be pulled taut in opposite directions in mutually overlapping relationships and releasable fastened to said upper by said hook and loop fastening material;

said first and second straps of said strap pair being aligned across said slot, and the attaching tab of either of said straps capable of being selectively and entirely extended through the opening between the spaced legs of the opposite strap.

8. Footwear in accordance with claim 1 wherein a reinforcing strip is attached adjacent to each of said first and second slot edges, said first and second straps being fixedly attached to said reinforcing strips.

9. Footwear comprising:

a sole;

and an upper attached to said sole;

said upper containing a longitudinal slot and securing means for securing said footwear upon a foot;

said slot haing a first edge and a second edge opposite thereto, and a reinforcing strip attached adjacent to each of said slot edges;

said securing means comprising a pair of closure straps, each strap of said strap pairs comprising two spaced legs joined together at one end and an attaching tab extending from said joined edge, and hook and pile fastening materials having a hook fastening component and a pile fastening component;

a first strap of said strap pair being integral with said reinforcing strip adjacent to said first edge at the end opposite the attaching tab and a second strap of said strap pair being integral with said reinforcing strip adjacent to said opposite second edge at the end opposite the attaching tab said, said first and second straps extending in opposite directions across said slot and overlapping each other longitudinally of said slot, each of said straps having one of said fastening components attached to the attaching tab thereof on a side thereof facing said upper, with the other of said fastening components attached adjacent to the longitudinal slot edge opposite to the edge to which the strap is attached, whereby said first and second straps can be pulled taut in opposite directions in mutually overlapping relationships and releasably fastened to said upper by said hook and loop fastening material;

said first and second straps of said strap pair being partially disaligned across said slot and each of said straps having a first portion extending through the opening between the spaced legs in the other strap and a second portion extending laterally outside of said other strap, said strap pair being permanently interlocked to prevent total disengagement of said strap pair, said reinforcing strip having a discontinuity between the spaced legs of at least one strap of said strap pair to permit said interlocking.

10. Footwear comprising:

a sole;

and an upper attached to said sole;

said upper containing a longitudinal slot and securing means for securing said footwear upon a foot;

said slot having a first edge and a second edge opposite thereto;

said securing means comprising a plurality of closure strap pairs, each strap of said strap pairs comprising a base portion and an attaching tab extending from said base portion, said securing means defining at least one strap receiving opening operatively associated with each of said strap pairs, and hook and pile fastening materials having a hook fastening component and a pile fastening component operatively associated with each of said straps;

a first strap of each of said strap pairs having its base portion fixedly attached to said first edge, and a second strap of each of said strap pairs having its base portion fixedly attached to said opposite second edge, said first and secnd straps extending in opposite directions across said slot and overlapping each other longitudinally of said slot with at least a portion of each of said second straps extending outwardly through the respective opening, each of said straps having one of the fastening components associated therewith attached to the attaching tab thereof on a side thereof facing said upper with the other of the fastening components associated therewith attached adjacent to the longitudinal slot edge opposite to the edge to which the respective strap is attached, whereby each pair of said first and second straps can be sequentially pulled taut in opposite directions in mutually overlapping relationship with at least a portion of each of said second straps extending through the respective opening and releasably fastened to said upper adjacent said slot edges by said hook and pile fastening materials.

11. Footwear according to claim 10 wherein a reinforcing strip is attached to said upper adjacent to each of said first and second slot edges, said first and second straps of each pair being fixedly attached to said reinforcing strips.

12. Footwear according to claim 10 or 11 wherein said first and second straps are partially disaligned across said slot, said openings extend through said first and second straps and each of said straps has a first portion extending through the opening in the other strap and a second portion extending laterally outside of said other strap, said strap pairs being thus permanently interlocked to prevent total disengagement of said straps.

13. Footwear according to claim 11 wherein said first and second straps are aligned across said slot, the base portion of said second strap underlies said first strap and the attaching tab of said second strap extends outwardly through said opening.

14. Footwear according to claim 13 wherein said opening extends through one of said reinforcing strips and said upper between the adjacent slot edge and the adjacent fastening component.

15. Footwear comprising:

a sole;

and an upper attached to said sole;

said upper containing a longitudinal slot and securing means for securing said footwear upon a foot;

said slot having a first edge and a second edge opposite thereto;

said securing means comprising a pair of closure straps, each of said straps comprising a base portion and an attaching tab extending from said base portion, and hook and pile fastening materials having a hook fastening component and a pile fastening component operatively associated with each of said straps;

a first strap of said strap pair having its base portion fixedly attached to said first edge, and a second strap of said strap pair having its base portion fixedly attached to said opposite second edge, said first and second straps extending in mutual alignment directly across from each other with said second strap underlying said first strap, each of said straps having one of the fastening components associated therewith attached to the attaching tab thereof on a side thereof facing said upper with the other of the fastening components associated therewith attached adjacent to the longitudinal slot edge opposite to the edge to which the respective strap is attached, said securing means defining an opening to receive outwardly therethrough the attaching tab of said underlying second strap for attachment of the fastening components associated therewith, whereby said first and second straps can be pulled taut in opposite directions across said slot with said second strap extending under said first strap and outwardly through said opening and releasably fastened to said upper by said hook and pile fastening materials.

16. Footwear according to claim 15 wherein said opening extends through said first strap.

17. Footwear according to claim 15 wherein said opening extends through said upper between said first edge and the adjacent fastening component.

18. Footwear according to claim 17 wherein a reinforcing strip is attached to said upper adjacent to each of said first and second slot edges, said first and second straps being fixedly attached to said reinforcing strips, and said opening extend coaxially through said upper and said reinforcing strip.

* * * * *